US007891998B1

(12) United States Patent
Gao et al.

(10) Patent No.: US 7,891,998 B1
(45) Date of Patent: Feb. 22, 2011

(54) CARD CONNECTOR WITH DETECTION TERMINAL UNIT

(75) Inventors: Ni Gao, Guang-Dong (CN); Wei-Hong Liao, Guang-Dong (CN); Ming-Chiang Chen, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/772,160

(22) Filed: Apr. 30, 2010

(51) Int. Cl.
*H01R 13/62* (2006.01)

(52) U.S. Cl. ..... 439/159; 439/630; 439/946

(58) Field of Classification Search ..... 439/159, 439/160, 630, 633, 946
See application file for complete search history.

(56) References Cited

U.S. PATENT DOCUMENTS 6,394,827 B2 * 5/2002 Nogami ..... 439/159
6,431,893 B1 * 8/2002 Chang et al. ..... 439/188
6,547,601 B2 * 4/2003 Oguchi ..... 439/630
6,896,532 B2 * 5/2005 Chang ..... 439/188
7,101,206 B2 * 9/2006 Chang ..... 439/188
7,128,589 B1 * 10/2006 Hsu ..... 439/159
7,410,375 B2 * 8/2008 Van der Steen et al. ..... 439/159
7,510,443 B2 * 3/2009 Ma ..... 439/630
7,549,876 B2 * 6/2009 Zhao et al. ..... 439/159
7,632,117 B1 * 12/2009 Van der Steen ..... 439/159

* cited by examiner

*Primary Examiner*—Hae Moon Hyeon
(74) *Attorney, Agent, or Firm*—Cheng-Ju Chiang

(57) ABSTRACT

A card connector includes an insulating housing, a detection terminal unit, and a shielding shell. The insulating housing defines a channel at a rear portion of a first side wall thereof. The detection terminal unit is mounted to the first side wall of the insulating housing and includes a contact terminal and a detection terminal. The contact terminal has a first elastic portion located in the channel and a contact portion formed at a free end of the first elastic portion. The detection terminal has a second elastic portion located inside of the contact terminal and a detection portion formed at a free end of the second elastic portion. When an electronic card is fully inserted into the card connector, the electronic card presses against the detection portion of the detection terminal and makes the detection portion deflect outwardly to electrically contact with the contact portion of the contact terminal.

4 Claims, 4 Drawing Sheets

CARD CONNECTOR WITH DETECTION TERMINAL UNIT

BACKGROUND OF THE INVENTION

1. Field of the Invention

The present invention relates to a card connector, and more particularly to a card connector capable of detecting whether an electronic card is fully inserted thereinto.

2. The Related Art

With the development of electronic technology, more and more electronic products, such as digital cameras, personal digital assistants (PDA) and mobile phones etc, are equipped with card connectors for receiving various electronic cards to achieve multiple functions.

Generally speaking, a conventional card connector includes an insulating housing, a plurality of terminals received in the insulating housing and a shielding shell covered on the insulating housing. An electronic card is inserted into the conventional card connector to electrically connect with the terminals for transmitting signals. However, it is difficult to identify whether the electronic card is fully inserted into the conventional card connector or not, because the conventional card connector does not provide any detection mechanism. If the electronic card is not fully inserted into the conventional card connector, the signals transmission between the terminals and the electronic card will be influenced and become unstable. Therefore, it is desirable to provide a card connector having detection function to overcome the problem encountered in the prior art.

SUMMARY OF THE INVENTION

It is an object of the present invention to provide a card connector capable of detecting whether an electronic card is fully inserted thereinto. The card connector for receiving an electronic card includes an insulating housing, a plurality of signal terminals, a detection terminal unit, and a shielding shell. The insulating housing includes a first and second side walls and a card-receiving cavity for receiving the electronic card formed between the side walls. A rear portion of the first side wall is cut off to form a channel communicating with the card-receiving cavity. The first side wall defines a first fixing slot in front of and communicating with the channel and a second fixing slot in front of and substantially in alignment with the first fixing slot. The first and second fixing slots are separated from each other by a first notch defined at a corresponding portion of the first side wall. The signal terminals are received in the insulating housing for electrically connecting with the electronic card. The shielding shell covered on the insulating housing. The detection terminal unit is mounted to the first side wall of the insulating housing and includes a contact terminal and a detection terminal. The contact terminal has a first fixed portion received in the first fixing slot. A first elastic portion is extended rearward from a rear end of the first fixing portion and located in the channel. A free end of the first elastic portion is projected inwardly to form a contact portion. The detection terminal has a second fixed portion which includes a front fixing branch received in the second fixing slot, a rear fixing branch with a small departure from the front fixing branch and against an inside of the first side wall, and a middle bent portion located in the first notch to connect the front fixing branch and the rear fixing branch. The second elastic portion is extended rearward from a rear end of the rear fixing branch and located inside of the contact terminal. A free end of the second elastic portion forms a detection portion located in the card-receiving cavity.

When the electronic card is fully inserted into the card-receiving cavity, a side of the electronic card presses against the detection portion of the detection terminal and makes the detection portion deflect outwardly to electrically contact with the contact portion of the contact terminal.

As described above, when the electronic card is fully inserted into the card-receiving cavity, a side of the electronic card will press against the detection portion of the detection terminal and make the detection portion deflect outwardly to electrically contact with contact portion of the contact terminal. Therefore, the card connector is capable of detecting whether the electronic card is fully inserted or not by the cooperation of the contact terminal and the detection terminal.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
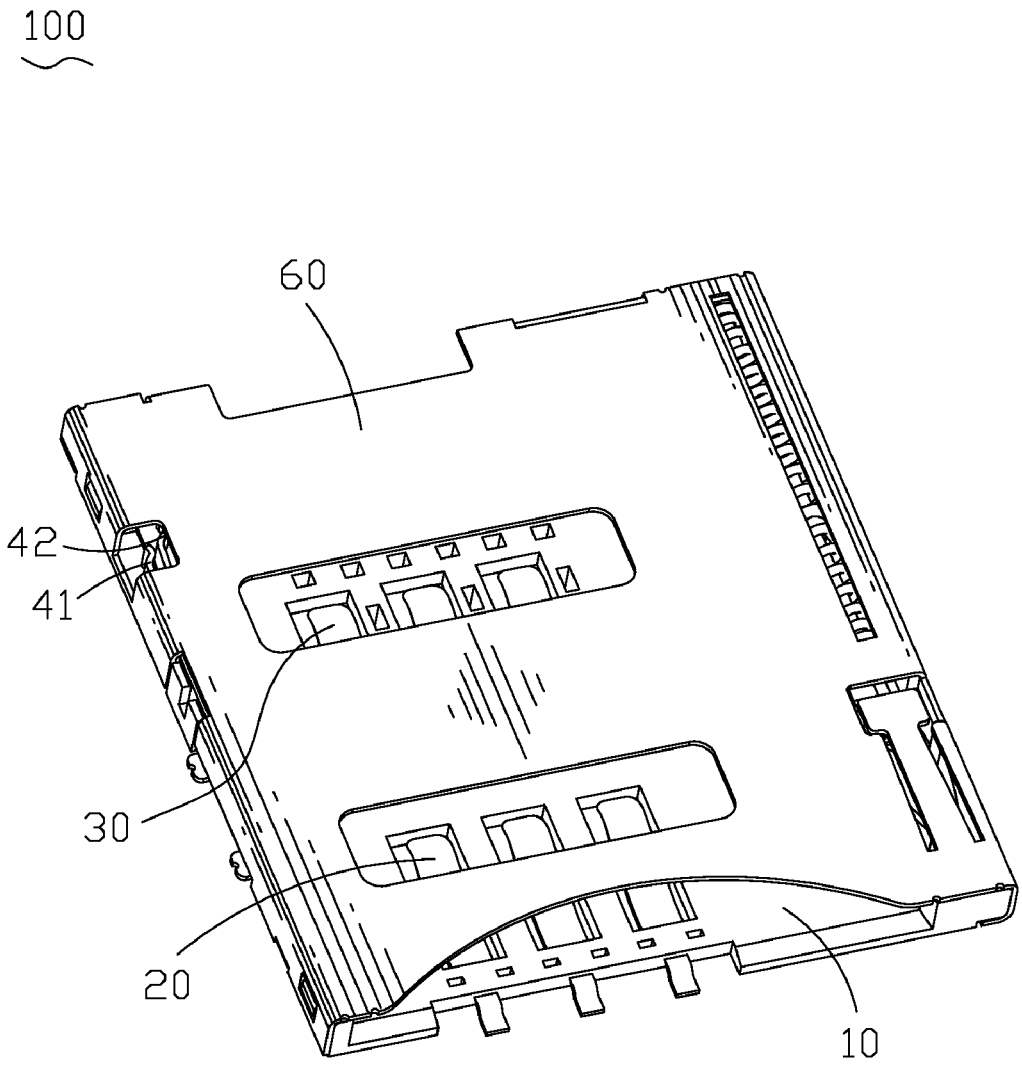
FIG. 1 is a perspective view of a card connector according to the present invention.
Figure 2:
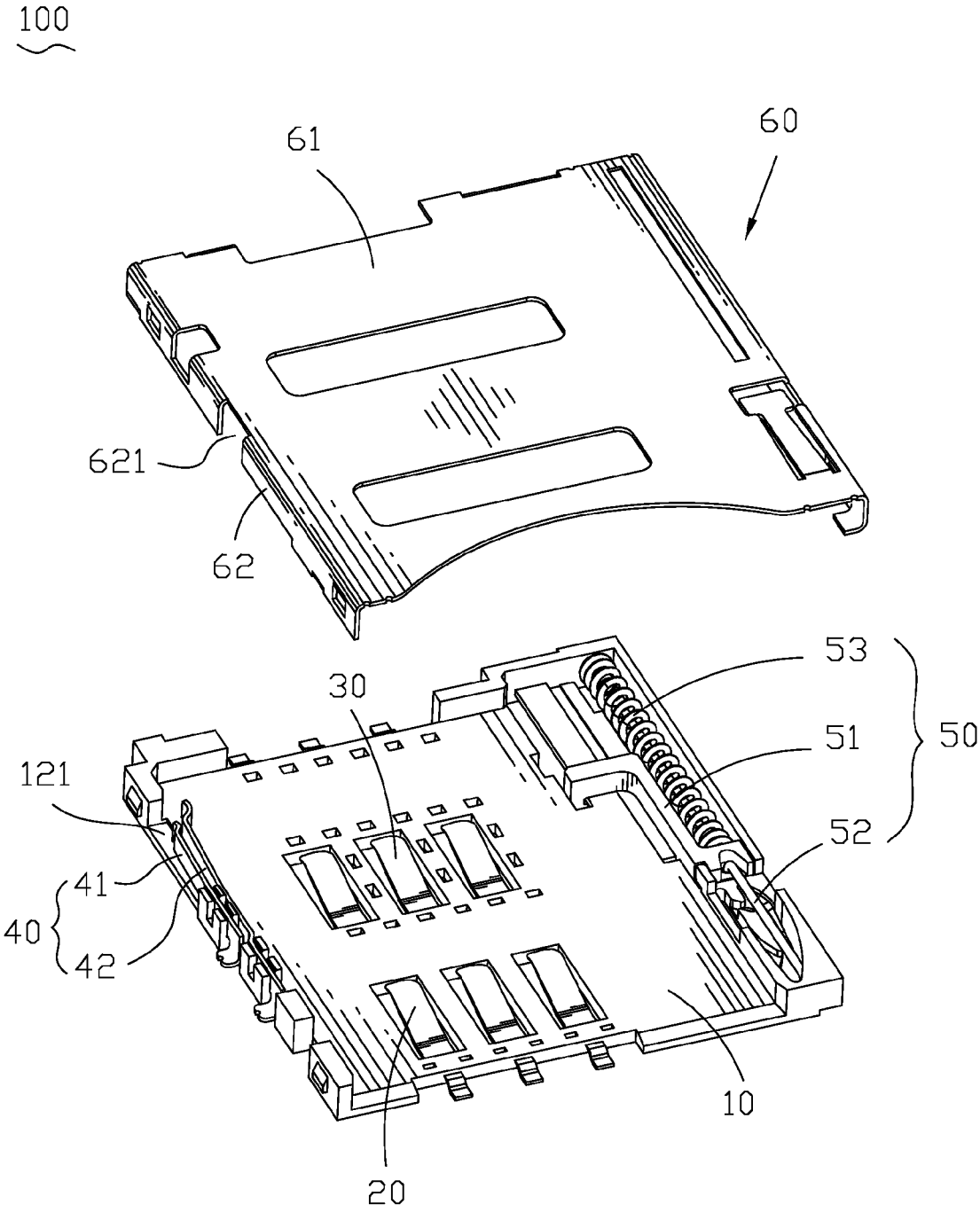
FIG. 2 is a partially exploded view of the card connector shown in FIG. 1.

With reference to FIG. 1 and FIG. 2, a card connector 100 according to the present invention includes an insulating housing 10, a plurality of first signal terminals 20 and second signal terminals 30 received in the insulating housing 10, a detection terminal unit 40 mounted to one side of the insulating housing 10, an ejector mechanism 50 mounted to the other side of the insulating housing 10 opposite to the detection terminal unit 40, and a shielding shell 60 covered on the insulating housing 10.

Figure 3:
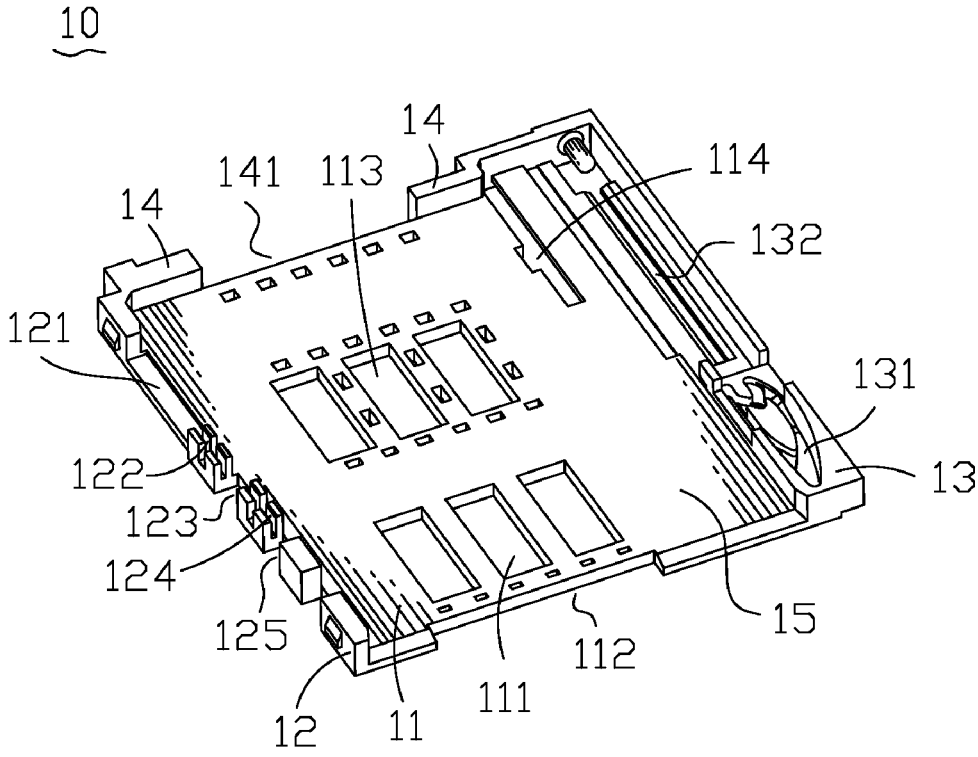
FIG. 3 is a perspective view of an insulating housing of the card connector.

With reference to FIG. 3, the insulating housing 10 has a bottom board 11, a first side wall 12, a second side wall 13 and a rear wall 14 respectively extended upwardly from two opposite sides and a rear side of the bottom board 11 to surround a card-receiving cavity 15 therebetween for receiving an electronic card (not shown). The bottom board 11 defines a plurality of first terminal grooves 111 abreast disposed at a front portion thereof and a plurality of second terminal grooves 113 abreast disposed at a middle portion thereof in alignment with the corresponding first terminal grooves 111. The bottom board 11 defines a first recess 112 transversely arranged at a front side thereof. A substantial middle portion of the rear wall 14 is transversely cut off to form a second recess 141.

A rear portion of the first side wall 12 is cut off to form a channel 121 communicating with the card-receiving cavity 15. The first side wall 12 defines a first fixing slot 122 in front of and communicating with the channel 121, and a second fixing slot 124 in front of and substantially in alignment with the first fixing slot 122. The first and second fixing slots 122, 124 are separated from each other by a first notch 123 defined at a corresponding portion of the first side wall 12. A second notch 125 is defined at a portion of the first side wall 12 to communicate with a front end of the second fixing slot 124. The second side wall 13 defines a heart-shaped groove 131 at a front portion thereof and a receiving groove 132 at a rear portion thereof. The heart-shaped groove 131, the receiving groove 132 together with a sliding groove 114 which is defined at a rear portion of the bottom board 11 are used for receiving the ejector mechanism 50 therein. The ejector mechanism 50 includes a slider 51, a guide pin 52 and a spring 53 which are known to one having ordinary skill in the art and will not describe in detail herein.

Figure 4:
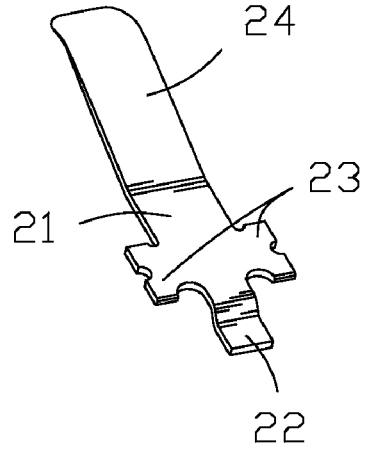
FIG. 4 is a perspective view of a first signal terminal of the card connector.

Referring to FIG. 2, FIG. 3 and FIG. 4, the first signal terminal 20 has a first base plate 21 and two shoulder portions 23 projected sideward from two opposite sides of the first base plate 21. The first base plate 21 and the shoulder portions 23 are all embedded into the bottom board 11 of the insulating housing 10. A first soldered plate 22 is bent forward from a front edge of the first base plate 21 and exposed outside from the bottom board 11 to be located in the first recess 112. A first contacting portion 24 is extended rearward from a rear edge of the first base plate 21 and received in the first terminal groove 111. The first contacting portion 24 further tilts upwardly and projects into the card-receiving cavity 15 for electrically connecting with the electronic card.

Figure 5:
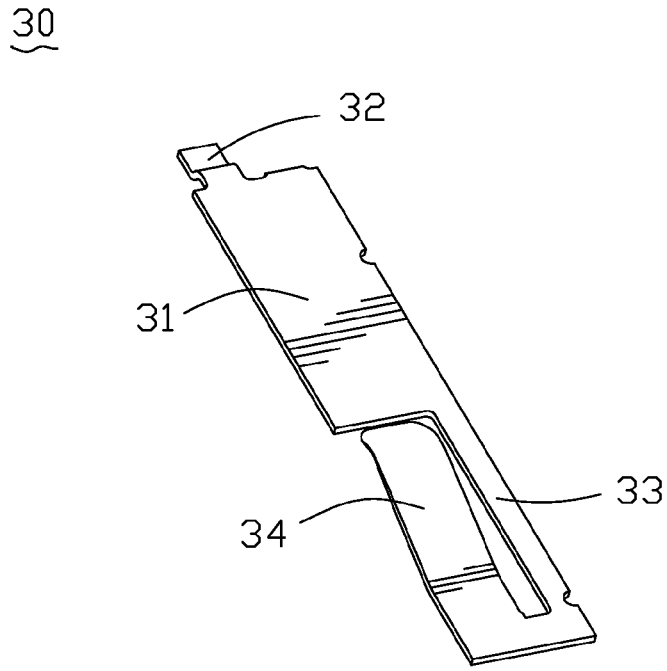
FIG. 5 is a perspective view of a second signal terminal of the card connector.

Referring to FIG. 2, FIG. 3 and FIG. 5, the second signal terminal 30 has a second base plate 31 and a narrow extending strip 33 extended forward from a side of a front edge of the second base plate 31. The second base plate 31 and the extending strip 33 are both embedded into the bottom board 11 of the insulating housing 10. A second soldered plate 32 is bent rearward from a side of a rear edge of the second base plate 31 and exposed outside from the bottom board 11 to be located in the second recess 141. A second contacting portion 34 is extended rearward from a front end of the extending strip 33 and received in the second terminal groove 114. The second contacting portion 34 further tilts upwardly and projects into the card-receiving cavity 15 for electrically connecting with the electronic card.

Figure 6:
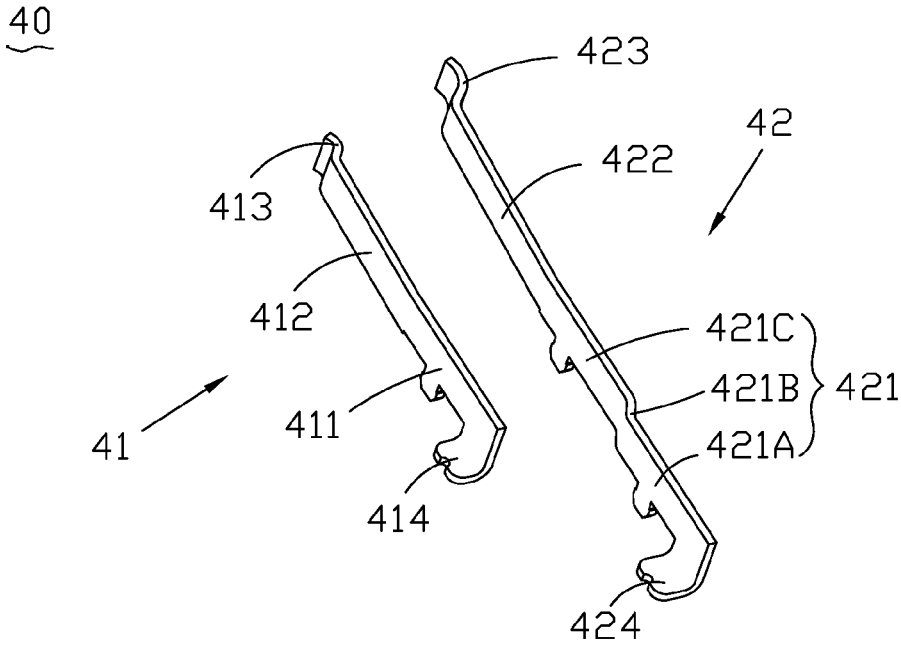
FIG. 6 is a perspective view of a detection terminal unit of the card connector.

Referring to FIG. 2, FIG. 3 and FIG. 6, the detection terminal unit 40 includes a contact terminal 41 and a detection terminal 42 both shaped as a strip and extended along an insertion direction of the electronic card. The contact terminal 41 has a first fixed portion 411 received in the first fixing slot 122. A first soldered portion 414 is bent outwardly from a front end of a bottom edge of the first fixed portion 411 and located in the first notch 123. A first elastic portion 412 is extended rearward from a rear end of the first fixing portion 411 and located in the channel 121. A free end of the first elastic portion 412 is further curved inwardly to form a contact portion 413.

The detection terminal 42 is similar to and longer than the contact terminal 41. The detection terminal 42 has a second fixing portion 421 which is divided into a front fixing branch 421A received in the second fixing slot 124, a rear fixing branch 421C with a small departure from the front fixing branch 421A and against an inner surface of the first side wall 12, and a middle bent portion 421B located in the first notch 123 to connect the front fixing branch 421A and the rear fixing branch 421C. A second soldered portion 424 is bent outwardly from a front end of a bottom edge of the front fixing branch 421A and located in the second notch 125. A second elastic portion 422 is extended rearward from a rear end of the rear fixing branch 421C and deflected inwardly to enter the card-receiving cavity 15 and located inside of the contact terminal 41. A free end of the second elastic portion 422 is further curved inwardly to form a detection portion 423.

With reference to FIG. 1 and FIG. 2 again, the shielding shell 60 has a cover plate 61 covered on the insulating housing 10 and two side plates 62 respectively extended downwardly from two opposite sides of the cover plate 61 to cover the first side wall 12 and the second side wall 13, correspondingly. An opening 621 is defined at a substantial middle portion of one side plate 62 which covers to the first side wall 12, for allowing a part of the first side wall 12 exposed outside therefrom.

During inserting the electronic card into the card connector 100, the electronic card will push the slider 51 to move rearward. At the same time, the spring 53 is compressed to store elastic potential energy, and the guide pin 52 is pulled by the slider 51 to slide rearward along the heart-shaped groove 131. When the guide pin 52 slides at a locked condition, the electronic card is fully inserted into the card-receiving cavity 15. In this case, a side of the electronic card presses against the detection portion 423 of the detection terminal 42 and makes the detection portion 423 deflect outwardly to electrically contact with the contact portion 413 of the contact terminal 41. If the users want to take back the electronic card, he can push the electronic card again to relieve the locked condition of the guide pin 52. Then, the slider 51 will be moved forward under the resiliency of the spring 53 to eject the electronic card from the card connector 100. In this case, the second elastic portion 422 of the detection terminal 42 returns to the original condition without contacting the contact portion 413 of the contact terminal 41.

As described above, when the electronic card is fully inserted into the card-receiving cavity 15, a side of the electronic card will press against the detection portion 423 of the detection terminal 42 and make the detection portion 423 deflect outwardly to electrically contact with the contact portion 413 of the contact terminal 41. Therefore, the card connector 100 is capable of detecting whether the electronic card is fully inserted or not by the cooperation of the contact terminal 41 and the detection terminal 42. In addition, the contact terminal 41 and the detection terminal 42 are both mounted to the first side wall 12, which saves occupied space and conforms to a miniaturization trend of the card connector 100.

What is claimed is:

1. A card connector for receiving an electronic card, comprising:

an insulating housing having a first and second side walls and a card-receiving cavity for receiving the electronic card formed between the side walls, a rear portion of the first side wall being cut off to form a channel communicating with the card-receiving cavity, the first side wall defining a first fixing slot in front of and communicating with the channel, and a second fixing slot in front of and substantially in alignment with the first fixing slot, the first and second fixing slots being separated from each other by a first notch defined at a corresponding portion of the first side wall;

a plurality of signal terminals received in the insulating housing for electrically connecting with the electronic card;

a shielding shell covered on the insulating housing; and a detection terminal unit mounted to the first side wall of the insulating housing, including:

a contact terminal, the contact terminal having a first fixed portion received in the first fixing slot, a first elastic portion being extended rearward from a rear end of the first fixing portion and located in the channel, a free end of the first elastic portion being projected inwardly to form a contact portion; and a detection terminal, the detection terminal having a second fixed portion, the second fixed portion including a front fixing branch received in the second fixing slot, a rear fixing branch with a small departure from the front fixing branch and against an inside of the first side wall, and a middle bent portion located in the first notch to connect the front fixing branch and the rear fixing branch, a second elastic portion being extended rearward from a rear end of the rear fixing branch and located inside of the contact terminal, a free end of the second elastic portion forming a detection portion located in the card-receiving cavity;

wherein when the electronic card is fully inserted into the card-receiving cavity, a side of the electronic card presses against the detection portion of the detection terminal and makes the detection portion deflect outwardly to electrically contact with the contact portion of the contact terminal.

2. The card connector as claimed in claim 1, wherein the contact terminal has a first soldered portion bent outwardly from a front end of a bottom edge of the first fixed portion to be located in the first notch.

3. The card connector as claimed in claim 2, wherein the first side wall of the insulating housing defines a second notch at a portion thereof to communicate with a front end of the second fixing slot, the detection terminal has a second soldered portion bent outwardly from a front end of a bottom edge of the front fixing branch to be located in the second notch.

4. The card connector as claimed in claim 1, further comprising an ejector mechanism mounted to the second side wall of the insulating housing opposite to the detection terminal unit.

* * * * *